US010248039B2

(12) United States Patent
Sawamoto et al.

(10) Patent No.: US 10,248,039 B2
(45) Date of Patent: Apr. 2, 2019

(54) CARRIER, ELECTROPHOTOGRAPHIC DEVELOPER, AND METHOD OF MANUFACTURING CARRIER

(71) Applicant: POWDERTECH CO., LTD., Chiba (JP)

(72) Inventors: Hiroki Sawamoto, Chiba (JP); Hajime Akiba, Chiba (JP); Tetsuya Uemura, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 15/696,698

(22) Filed: Sep. 6, 2017

(65) Prior Publication Data

US 2018/0074426 A1 Mar. 15, 2018

(30) Foreign Application Priority Data

Sep. 14, 2016 (JP) ..... 2016-179212

(51) Int. Cl.
*G03G 9/113* (2006.01)
*G03G 9/107* (2006.01)
*G03G 9/10* (2006.01)

(52) U.S. Cl.
CPC ..... *G03G 9/1133* (2013.01); *G03G 9/10* (2013.01); *G03G 9/107* (2013.01); *G03G 9/1075* (2013.01); *G03G 9/1131* (2013.01); *G03G 9/1132* (2013.01); *G03G 9/1136* (2013.01)

(58) Field of Classification Search
CPC .. G03G 9/1075; G03G 9/1132; G03G 9/1136; G03G 9/1139
See application file for complete search history.

(56) References Cited

U.S. PATENT DOCUMENTS

| | | | | |
|---|---|---|---|---|
| 2010/0248125 | A1* | 9/2010 | Hikichi | G03G 9/1075 430/111.1 |
| 2011/0195357 | A1 | 8/2011 | Sugiura et al. | |
| 2012/0251191 | A1 | 10/2012 | Sugiura et al. | |
| 2014/0287355 | A1 | 9/2014 | Sawamoto et al. | |
| 2015/0192874 | A1 | 7/2015 | Kinoshita et al. | |
| 2016/0216643 | A1 | 7/2016 | Sawamoto et al. | |

FOREIGN PATENT DOCUMENTS

| | | | | |
|---|---|---|---|---|
| EP | 3051354 | A1 * | 8/2016 | G03G 9/10 |
| JP | 2007034249 | A | 8/2007 | |
| JP | 2012215858 | A | 11/2012 | |
| JP | 2012215875 | A | 11/2012 | |
| JP | 2013250455 | A | 12/2013 | |
| JP | 2014197040 | A | 10/2014 | |
| JP | 2016139008 | A | 8/2016 | |

OTHER PUBLICATIONS

European Search Report from Application No. 17190633.2 dated Nov. 23, 2017.

* cited by examiner

*Primary Examiner* — Peter L Vajda
(74) *Attorney, Agent, or Firm* — Greenblum & Bernstein, P.L.C.

(57) ABSTRACT

An object of the present invention is to provide a carrier low in specific gravity and less in both environmental fluctuation and change of the charge amount after aging, an electrophotographic developer using the carrier, and a method of manufacturing the carrier. To achieve the object, the carrier is manufactured by coating a core material composed of a magnetic component and a non-magnetic component with a resin, and the carrier is characterized in that water content is 200 ppm or less and cyclic siloxane content is 100 ppb or less. Further, an electrophotographic developer containing the carrier is provided.

8 Claims, No Drawings

CARRIER, ELECTROPHOTOGRAPHIC DEVELOPER, AND METHOD OF MANUFACTURING CARRIER

BACKGROUND OF THE INVENTION

Field of the Invention

The present invention relates to a carrier in which a core material composed of a magnetic component and a non-magnetic component is coated with a resin, an electrophotographic developer using the carrier, and a method of manufacturing the carrier.

Background Art

The method of the electrophotographic developing is that the toner in the developer is attached on the electrostatic latent image formed on the photo conductor followed by developing the image. Now, a magnetic brush method using the magnet roller is widely employed as the method of the electrophotographic developing. Developers used in the method are categorized into the two-component developer composed of a toner and a carrier, and the one-component developer using just a toner.

In the two-component developer, the functions of the carrier is to triboelectrically charge the toner in mixing and stirring the carrier with the toner, and transportation of the toner. As compared with the one-component developer, the two-component developer has good controllability in design of the developer. So, the two-component developer is widely used in full color developing devices that require high image quality, and high speed printing devices that require reliability and durability on images.

If the two-component developer is used, characteristics of the image such as image density, fogging, white spots, tone reproduction, and resolution should be in the specific grades at the starting. Further, these characteristics should be stably achieved without fluctuation in the endurance printing. So, not only high reliability but also high-definition and high image quality are required for developers.

Although, an iron powder carrier, a ferrite carrier, a resin-coated ferrite carrier have been used as a carrier for the two-component developer, reduction in specific gravity of the carrier is required in recent years. If the specific gravity of the carrier is reduced, the stress on the carrier in stirring is reduced. As a result, the deterioration of the carrier caused by cracking or chipping of the carrier and/or separation of the coated resin and spent that is the adhesion of the toner on the carrier are reduced. So, the lifetime of the developer is made long, and the matter is effective for reducing of the frequency of maintenance of a copier or making it free from maintenance.

In such a situation, various carriers such as a carrier using a core material having a hollow structure disclosed in Japanese Patent Laid-Open No. 2007-034249, a carrier using a core material having a porous structure disclosed in Japanese Patent Laid-Open No. 2012-215858, and a magnetic powder-dispersed resin carrier wherein a magnetic powder is dispersed in a resin disclosed in Japanese Patent Laid-Open No. 2013-250455 have been proposed as a carrier having low specific gravity. However, even though these carriers have a reduced specific gravity, various drawbacks such as insufficient strength of the core material or insufficient magnetic properties or electrical properties required as a carrier have not been resolved. So, achievement of a developer with high reliability has been difficult.

As a carrier having low specific gravity which solves the drawbacks, a resin-filled carrier in which pores of a core material having a porous structure are filled with a resin is disclosed in Japanese Patent Laid-Open No. 2014-197040). The resin-filled carrier is not only reduced the specific gravity of the carrier, but also ensures the strength of the core material, and the magnetic properties and electrical properties required as a carrier is satisfied. As a result, a developer having high reliability is provided.

In recent years, from the viewpoint of reducing the environmental load, reduction of the volatile organic compound (VOC) content in a carrier is also required. In the resin-filled carrier disclosed in Japanese Patent Laid-Open No. 2014-197040, volatile organic compounds remain in the carrier because a volatile organic solvent is used in the manufacturing process of the core material of the carrier. Also the magnetic powder-dispersed resin carrier disclosed in Japanese Patent Laid-Open No. 2013-250455 has the same drawback.

So, Japanese Patent Laid-Open No. 2016-139008 proposes a carrier using a core material composed of a magnetic component and a non-magnetic component in which the non-magnetic component is finished by curing a resin compound prepared without using volatile organic solvents. The carrier is reduced the amount of the volatile organic compounds remaining in the carrier as compared with the conventional resin-filled carrier or the conventional magnetic powder-dispersed resin carrier.

SUMMARY OF THE INVENTION

However, the carrier using a core material composed of a magnetic component and a non-magnetic component disclosed in Japanese Patent Laid-Open No. 2016-139008 fluctuate charge amount with the temperature change and the humidity change in the atmosphere and changes charge amount as compared with a carrier with a core material composed of just a magnetic component. So, these drawbacks should be resolved to further improve the reliability and make the life time of the developer long.

So, an object of the present invention is to provide a carrier low in specific gravity and less in both environmental fluctuation and change of the charge amount after aging, an electrophotographic developer, and a method of manufacturing the carrier.

To achieve the object of the present invention, a carrier according to the present invention is a resin coated core material composed of a magnetic component and a non-magnetic component, and the carrier is characterized in that water content is 200 ppm or less and cyclic siloxane content is 100 ppb or less.

The carrier is preferable to have a volatile organic compound content of 1.5 ppm or less.

The carrier is preferable to have a true specific gravity of 3.5 g/cm$^3$ or more and 4.5 g/cm$^3$ or less.

The magnetic component is preferable to be a ferrite.

The non-magnetic component is preferable to be a siloxane compound comprising one or more groups selected from methyl groups and phenyl groups.

The non-magnetic component is preferable to be finished by curing a non-magnetic component composition without volatile organic solvents containing a siloxane compound having a mass average molecular weight of 150 to 10000.

The core material is preferable to be composed of porous ferrite particles and the non-magnetic component filling the pores of the porous ferrite particles.

To achieve the object of the present invention, an electrophotographic developer according to the present invention contains the carrier described above.

To achieve the object of the present invention, a method of manufacturing the carrier in which a core material composed of a magnetic component and a non-magnetic component is coated with a resin is characterized in that the non-magnetic component is finished by curing the non-magnetic component composition containing the siloxane compound having a mass average molecular weight of 150 to 10000.

The method of manufacturing the carrier according to the present invention is preferable that the siloxane compound comprising one or more groups selected from methyl groups and phenyl groups, and a molar content ratio of the methyl groups and the phenyl groups in the non-magnetic component composition is 10:0 to 10:6.

The method of manufacturing the carrier according to the present invention is preferable that the non-magnetic component composition contains the siloxane compound and titanium alkoxide and is prepared without using volatile organic solvents.

The method of manufacturing the carrier according to the present invention is preferable that the magnetic component is porous ferrite particles, and the non-magnetic component composition is cured after filling the pores of the porous ferrite particles with the non-magnetic component composition.

The present invention provides the carrier that is low in specific gravity and less in environmental fluctuation of the charge amount and less in change of the charge amount after aging, the electrophotographic developer using the carrier, and the method of manufacturing the carrier.

DETAILED DESCRIPTION OF THE PREFERRED EMBODIMENTS

Embodiments of the carrier, the electrophotographic developer, and the method of manufacturing the carrier according to the present invention will be described.

1. Carrier

The embodiments of the carrier according to the present invention will be described. The carrier according to the present invention is manufactured by coating a core material composed of a magnetic component and a non-magnetic component with a resin, and the carrier is characterized in that water content is 200 ppm or less and cyclic siloxane content is 100 ppb or less.

The carrier according to the present invention manufactured by coating the core material composed of the magnetic component and the non-magnetic component with a resin ensures the strength of the core material and is reduced the specific gravity. So, the stress in stirring is reduced, and the lifetime of the electrophotographic developer using the carrier is made longer.

However, if the carrier using the core material composed of the magnetic component and the non-magnetic component is compared with a carrier using a core material composed of just a magnetic component, the charge amount is dependent on environment, i.e. the charge amount fluctuates with the environment change, temperature and humidity where the carrier is used. Further, if the electrophotographic developer is composed of the carrier and the toner, charge amount changes by aging, i.e. the charge amount reduces after aging. The present inventors have thought out that such drawbacks are solved by controlled water content in the carrier of 200 ppm or less and controlled cyclic siloxane content in the carrier of 100 ppb or less, and the present invention is accomplished. Hereinafter, the core material and the coating resin will be described in this order, and water content, cyclic siloxane content of the carrier will be described. In the descriptions, the words "core material" or "the carrier" represents an aggregation of individual core material particles or an aggregation of individual carrier particles, that is, a powder unless otherwise specified. Further, the words "core material particles" or "the carrier particles" represents individual core material particles or individual carrier particles.

1-1. Core Material

In the present invention, the core material is composed of the magnetic component and the non-magnetic component. Hereinafter, the magnetic component and the non-magnetic component constituting the core material will be described in this order.

(1) Magnetic Component i) Composition

In the present invention, various ferrites are employed as the magnetic component. The composition of the ferrite is not particularly limited but the ferrite containing at least one selected from Mn, Mg, Li, Ca, Sr, Cu, Zn, and Ni is preferable. Magnetite may be acceptable. Note that, it is preferable not to contain heavy metals such as Cu, Zn, and Ni exceeding the range of unavoidable impurities (accompanying impurities) to reduce the environmental load.

ii) Structure

The magnetic component is preferable to be composed of porous ferrite particles. The carrier according to the present invention may be a so-called magnetic powder-dispersed resin carrier which contains a magnetic powder composed of magnetite as the magnetic component, i.e. the magnetic powder is dispersed in a non-magnetic component such as a resin. However, the magnetic powder-dispersed resin carrier has drawbacks, high residual magnetization, high coercive force, and poor rising performance of the electric charging. Next, the electric resistivity of the carrier is high, and it is difficult to achieve the desired image density. Further, the magnetic powders dispersed in the non-magnetic component detached from the magnetic powder-dispersed resin carrier may damage the photo conductor. In contrast, if the non-magnetic component-filled carrier prepared by employing porous ferrite particles as the magnetic component and filling the pores of the porous ferrite particles with the non-magnetic component, the strength required as a carrier is ensured, and the lifetime of the electrophotographic developer is made long because the specific gravity is small. At the same time, the desired magnetic properties are easily achieved, and the electrical properties such as the electric resistivity and the charging characteristic are also excellent. From these reasons, the magnetic component is preferable to be porous ferrite particles in the present invention.

iii) Pore volume and Peak Pore Size

The pore volume of the porous ferrite particles is preferable to be 40 $mm^3/g$ or more and 100 $mm^3/g$ or less. The peak pore size of the porous ferrite particles is preferable to be 0.3 μm or more and 1.5 μm or less. A non-magnetic component-filled carrier appropriately reduced the weight is manufactured by using the porous ferrite particles having the pore volume and the peak pore size in the range as the magnetic component.

If the pore volume is less than 40 $mm^3/g$, the pores of the porous ferrite particles cannot be filled with a sufficient amount of the non-magnetic component. So, it is difficult to reduce the weight. In contrast, if the pore volume exceeds 100 $mm^3/g$, the strength of the carrier cannot be achieved even if the pores of the porous ferrite particles are filled with the non-magnetic component. So, the porous ferrite particles having the pore volume outside the range is not preferable as the magnetic component.

If the peak pore size is 0.3 μm or more, the projections and the recesses on the surface of the core material have an appropriate size even after filling the non-magnetic component. As a result, increased contact area between the carrier and the toner makes triboelectric charging between the carrier and the toner in stirring efficient. So, a carrier having excellent initial charging property while having low specific gravity is achieved. In contrast, if the peak pore size is less than 0.3 μm, the projections and the recesses on the surface of the core material are small. As a result, the surface of the core material after filling the non-magnetic component might be smooth. After the carrier is prepared by coating the core material with the resin, the surface is made smoother. If the surface of the carrier is smooth, the triboelectric charging of the toner with the carrier having low specific gravity cannot be efficiently achieved in stirring and it makes initial charging property poor.

In contrast, if the peak pore size exceeds 1.5 μm, opening diameter of the pore on the surface of the porous ferrite particles is too large. So, if the pores of the porous ferrite particles are filled with the non-magnetic component, the particles tend to aggregate with each other. As a result, the prepared carrier may contain a large amount of aggregated particles. As a result, if the aggregated particles disaggregate due to the stress on the carrier in endurance printing, charge fluctuates in the carrier. Further, if the peak pore size exceeds 1.5 μm, the projections and the recesses on the surface of the porous ferrite particles are too large, and the shape of the porous ferrite particles is deformed to reduce the strength of the particles. So, cracking and chipping tend to occur due to the stress applied in endurance printing. The cracking and chipping of deformed particles may fluctuates charge in the carrier. So, the peak pore size of over 1.5 μm is not preferable because the charge tends to fluctuate in endurance printing.

iv) The method of Determining the Pore Volume and the Peak Pore Size

The pore volume and the peak pore size is examined by mercury porosimetry. The mercury porosimeter (for example, Pascal140: manufactured by Thermo Fisher Scientific Inc.) for the low-pressure region (0 to 400 kPa) and the mercury porosimeter (for example, Pascal240: manufactured by Thermo Fisher Scientific Inc.) for the high-pressure region (0.1 MPa to 200 MPa) are used as the examination devices.

If the examination devices described above are used, the pore volume and the peak pore size of the sample is determined by the following procedure. First, the press fitted amount of mercury in the low-pressure region is determined using the mercury porosimeter for the low-pressure region. In the examination, the sample enclosed in the commercially available gelatin capsule having a plurality of holes is housed in the dilatometer (CD3P (for powder)), and the dilatometer is set at the specific position in the mercury porosimeter. The sample is first degassed, mercury is filled and the press fitted amount of mercury is examined. This procedure is referred to as 1st Run. Next, in the same manner as in 1st Run, the sample is degassed, and the press fitted amount of mercury is examined again. This procedure is referred to as 2nd Run. After 2nd Run, the total weight of the dilatometer, the mercury, the gelatin capsule, and the sample is examined. Next, the mercury porosimeter for the high-pressure region is used, the press fitted amount of mercury in the high-pressure region is examined by the same procedure as in 2nd Run. Based on the press fitted amount of mercury in the high-pressure region, the pore volume and the peak pore size of the porous ferrite particles is determined. Note that, the surface tension of mercury is assumed to be 480 dyn/cm, and the contact angle of mercury is assumed to be 141.3° in the calculation for determination of the pore size.

The porous ferrite particles is appropriately manufactured by a known method. In the methods, the pore volume and the peak pore size is appropriately controlled by various means such as the types of raw materials, the degree of pulverization of the raw materials, the including or excluding of calcination, the calcination temperature, the calcination time, the amount of binder in granulation with the spray dryer, the firing device, the firing temperature, the firing time, and the firing atmosphere (whether a reducing gas atmosphere is employed or not).

(2) Non-Magnetic Component

The non-magnetic component according to the present invention is preferable to be the compound containing silicon as the main component, more preferable to be the siloxane compound, further preferable to be the siloxane compound comprising one or more groups selected from methyl groups and phenyl groups. Further, the siloxane compound is further preferable to have the molar content ratio of the methyl groups and the phenyl groups of 10:0 to 10:6. If the siloxane compound is used as the non-magnetic component, water content in the carrier is adjusted to 200 ppm or less and cyclic siloxane content is adjusted to 100 ppb or less.

i) Non-Magnetic Component Composition

The non-magnetic component is preferable to be finished by curing the non-magnetic component composition containing silicon as the main component, particularly, the siloxane compound. The non-magnetic component preferable for preparation of the carrier according to the present invention is finished by curing a non-magnetic component composition containing siloxane compound as the main component having the mass average molecular weight of 150 to 10000. The siloxane compound contained in the non-magnetic component composition is more preferable that the molar content ratio of the methyl groups and the phenyl groups is 10:0 to 10:6.

Further, as the non-magnetic component composition containing the siloxane compound is prepared without using volatile organic solvents, the amount of volatile organic solvents used in the manufacturing process of the carrier is reduced, and the amount of volatile organic compounds remaining in the carrier is 1.5 ppm or less. The non-magnetic component composition is mainly composed of the siloxane compound and may contain other components such as a curing catalyst described later according to needs.

ii) Method of Determining the Mass Molecular Weight

The mass average molecular weight of the siloxane compound contained in the non-magnetic component composition is examined by gel permeation chromatography (GPC) as follows.

30 mg of siloxane compound is dissolved in 10 mL of tetrahydrofuran for high performance liquid chromatography (THF for HPLC). The solution prepared is filtrated by a disposable filter having a pore size of 0.45 μm and made of polytetrafluoroethylene (PTFE) to prepare the sample. The mass average molecular weight of the siloxane compound is determined with the following analyzer and analysis conditions using the sample prepared.

GPC apparatus: HLC-8220GPC (manufactured by Tosoh Corporation)
Guard column: TSKguardcolum HXL-H
Column: 2 columns of TSKgel GMHXL, 1 column of TSKgel G3000HXL, and 1 column of TSKgel G2000HXL
Column temperature: 40° C.
Eluent: THF for HPLC
Eluent flow rate: 1.0 mL/minute
Injection amount: 200 μL
Analysis time: 50 minutes
Detector: RI
Analysis software: GPC8020 modelII
Standard sample 1: Shodex STANDARD polystyrene SM-105 (molecular weight: 3.73E6, 2.48E6, 5.79E5, 1.33E5, 5.51E4, 3.14E4, 1.30E4, 2.94E3, and 1.28E3)
Standard sample 2: Shodex polystyrene A-300 (molecular weight 3.70E2)

iii) Method of Determining the Molar Content Ratio of Methyl Groups and Phenyl Groups The molar content ratio of the methyl groups and the phenyl groups in the siloxane compound used in preparation of the non-magnetic component composition is determined with nuclear magnetic resonance (NMR) as follows.

The siloxane compound is dissolved in deuterated chloroform, and 1H-NMR spectrum of the solution prepared is examined with the NMR examination device (type: VNMRS 600, manufactured by Varian Medical Systems, Inc.).

The examination conditions are, the cumulative number of times is 16 times, and the solvent peak (7.27 ppm) is the internal standard. In the analysis, the peak at −0.6 to +0.6 ppm is regarded as the peak derived from the methyl groups, and the peak at 6.2 to 8.3 ppm is regarded as the peak derived from the phenyl groups, to calculate the ratio of the functional groups.

iv) Curing Catalyst

The non-magnetic component composition may contain the appropriate amount of various organic metal compounds as the curing catalyst at discretion. Examples of the organic metal compounds include alkoxide and chelate of titanium, zirconium, aluminum, silicon, and tin. Among these, the non-magnetic component composition is preferable to contain titanium alkoxide.

v) Charge Control Agent

The non-magnetic component composition may contain an appropriate amount of the coupling agent such as an aminosilane coupling agent and a fluorine-based silane coupling agent, a nigrosine dye, a quaternary ammonium salt, an organic metal complex, or a metal-containing monoazo dye, as a charge control agent at discretion. As the aminosilane coupling agents, 3-glycidoxypropyltrimethoxysilane and 3-glycidoxypropylmethyldiethoxysilane are used.

vi) Conducting Agent

The non-magnetic component composition may contain an appropriate amount of a conductive carbon, a metal oxide such as titanium oxide and tin oxide, or various organic conducting agents, as a conducting agent at discretion.

vii) Others

Note that, the non-magnetic component composition containing the siloxane compound used in preparation of the non-magnetic component is not restrictive in the present invention, and the non-magnetic component may be prepared using a non-magnetic component composition containing an organic silane compound, an organic titanium compound, or an organic zirconium compound. If the a non-magnetic component composition containing an organic silane compound, an organic titanium compound, or an organic zirconium compound used as a silane coupling agent, a titanium coupling agent, or a zirconium coupling agent are used and polymerized and cured, polymer compound containing silicon, titanium, or zirconium can be prepared. As the same in the case using the siloxane compound, water content in the carrier is 200 ppm or less, and cyclic siloxane content is 100 ppb or less.

(3) Content Ratio of Magnetic Component and Non-Magnetic Component

The content ratio of the magnetic component and the non-magnetic component in the core material is determined corresponding to the required properties of the carrier at discretion.

If the magnetic component is the porous ferrite particles, the filling amount of the non-magnetic component in the porous ferrite particles is preferable to be 2 mass % or more and 20 mass % or less. If the filling amount of the non-magnetic component in the porous ferrite particles is less than 2 mass %, the porous ferrite particles cannot be sufficiently filled with the non-magnetic component. As a result, if the carrier is used as a developer, insulation breakdown occurs by applied high electrical field and causes image defects such as white spots. If the filling amount of the non-magnetic component in the porous ferrite particles exceeds 20 mass %, the excess non-magnetic component flows over the surface of the porous ferrite particles to result excessively high electric resistivity in the carrier. So, the image density may possibly decrease in the use as the developer. The filling amount of the non-magnetic component is preferable to be appropriately adjusted corresponding to the pore volume of the porous ferrite particles.

The method of filling the porous ferrite particles with the non-magnetic component composition may be a known method such as brushing, spray drying with the fluidized bed, rotary drying, and immersion drying with the versatile mixer. In particular, the method that the pores of the porous ferrite particles are filled with the non-magnetic component composition while the porous ferrite particles and the non-magnetic component composition are mixed under stirring using the versatile mixer is preferable. The step of filling the non-magnetic component composition is carried out in multiple times.

A core material filled with the non-magnetic component in the pores of the porous ferrite particles is prepared by filling the porous ferrite particles with the non-magnetic component composition followed by curing the non-magnetic component composition.

To cure the non-magnetic component composition, thermal curing may be finished by heat treatments including external heating with the fixed or fluidized electric furnace, a rotary electric furnace, a burner furnace, or internal heating by microwaves. If the thermal curing is employed in preparation of the carrier according to the present invention, the heating is preferable to be appropriately carried out for a specific time at the temperature to sufficiently cure the non-magnetic component composition not to remain the uncured materials. Specific heating conditions is adjusted corresponding to the non-magnetic component composition at discretion.

1-2. Coating Resin

The carrier according to the present invention is the core material coated with a resin. The resin (coating resin) for coating the core material is not particularly limited. Examples include a fluororesin, an acrylic resin, an epoxy resin, a polyamide resin, a polyamide-imide resin, a polyester resin, an unsaturated polyester resin, a urea resin, a melamine resin, an alkyd resin, a phenolic resin, a fluorine acrylic resin, an acrylic-styrene resin, and a silicone resin, or a modified silicone resin modified by a resin such as an acrylic resin, a polyester resin, an epoxy resin, a polyamide resin, a polyamide-imide resin, an alkyd resin, a urethane resin, and a fluororesin. An acrylic resin, a silicone resin, or a modified silicone resin is particularly preferable to be used in the present invention.

The coating resin may contain a conducting agent including a conductive carbon, an oxide such as titanium oxide and tin oxide, and various organic conducting agents. The content of the conducting agent in the coating resin is adjusted to an appropriate amount at discretion. The coating resin may contain an appropriate amount of a charge control agent including a nigrosine dye, a quaternary ammonium salt, an organic metal complex, a metal-containing monoazo dye, or a coupling agent such as an aminosilane coupling agent and a fluorine-based silane coupling agent at discretion.

The amount of the coating resin on the core material is preferable to be 0.5 mass % or more and 4 mass % or less against to the core material. If amount of the coating resin is less than 0.5 mass %, it is difficult to provide a uniform coated layer on the surface of the carrier. If amount of the coating resin exceeds 4 mass %, aggregation occurs in the carrier to cause not only a reduction in productivity such as poor yield but also a fluctuation in developer performances such as the fluidity and the charge amount in the actual machine when used in a developer.

The methods of coating the core material with the coating resin include brushing, spray drying with the fluidized bed, rotary drying, and immersion drying with the versatile mixer, in the same manner as in the case of filling the porous ferrite particles with the non-magnetic component composition. Further, heat treatment may be carried out at discretion by external heating or internal heating after the core material is coated with the coating resin, in the same manner as in the case of curing the non-magnetic component composition.

1-3. Water Content

(1) Water Content in the Carrier

Water content in the carrier according to the present invention is 200 ppm or less. Water content is preferable to be 190 ppm or less, more preferable to be 180 ppm or less. If water content in the carrier is 200 ppm or less, the environmental fluctuation in charge amount of the carrier is reduced. If water content in the carrier is 200 ppm or less, the fluctuation in the amount of water adsorbed on the carrier is reduced, even if humidity or temperature in the atmosphere of the carrier fluctuates. If the amount of water adsorbed on the carrier fluctuates, the charge amount of the carrier also fluctuates. So, the environmental fluctuation in charge amount of the carrier is reduced by controlling water content in the carrier to be 200 ppm or less.

To control water content in the carrier up to the upper limit, it is preferable to prepare the non-magnetic component by using a non-magnetic component composition containing a siloxane compound, an organic silane compound, an organic titanium compound, or an organic zirconium compound. Water content in the carrier is adjusted to 200 ppm or less by using the non-magnetic component composition containing a siloxane compound, an organic silane compound, an organic titanium compound, or an organic zirconium compound. Note that, the non-magnetic component composition is preferable to be mainly composed of the compounds listed above, and it is particularly preferable to use the non-magnetic component composition containing the siloxane compound as a main component. If the non-magnetic component is prepared by using the non-magnetic component composition mainly composed of the siloxane compound, water content in the carrier is adjusted to 200 ppm or less and water content in the core material is adjusted to a certain value or less by appropriately adjusting the curing conditions (such as the curing catalyst, the curing temperature, and the curing time) of the non-magnetic component composition. Note that, if the core material is coated with the coating resin after preparing the core material, water content in the carrier does not greatly increase if the suitable coating resin that is less likely to contain moisture is selected, because water content in the core material is controlled to a specific value or less. If the same curing conditions are employed, the larger molar content ratio of the phenyl groups in the siloxane compound contained in the non-magnetic component composition in the range tends to make preparation of the carrier with the small water content easy.

(2) Water Content in Core Material

Water content in the core material before the coating with the resin is preferable to be 200 ppm or less, more preferable to be 180 ppm or less, further preferable to be 160 ppm or less.

(3) Method of Determining the Water Content

Water content in the carrier and the core material is determined with Karl Fischer moisture analyzer by coulometric titration (MKC-710S, manufactured by Kyoto Electronics Manufacturing Co., Ltd.). Water content is determined as the water generated in heating the sample at 110° C. with the water vaporizer (ADP-611). In the examination, the sample exposed to a normal-temperature and normal-humidity environment for 24 hours is used.

1-4. Determination of Cyclic Siloxane Content (1) Cyclic Siloxane Content in Carrier The cyclic siloxane content in the carrier according to the present invention is 100 ppb or less. Note that, cyclic siloxane is a compound having a cyclic skeleton including siloxane bonds (—Si—O—Si—) in the molecular structure. Cyclic siloxane content in the carrier is the amount of the cyclic siloxane compound contained in the carrier.

The inventors considered that the change of the charge amount of the carrier after aging in the carrier prepared by coating the core material composed of the magnetic component and the non-magnetic component with the resin originates to the amount of the cyclic siloxane compound contained in the carrier. By the way, the matter is known that a high molecular weight siloxane compound which is the cyclic siloxane generates in the silicone resin causes contact failure in electronic devices. So, the cyclic siloxane in the carrier adsorbed on the surface of the toner in a two-component electrophotographic developer changes the surface state of the toner and results decrease of the efficiency of the triboelectric charge between the carrier and the toner. As a result, the charging property of the carrier is made poor. So, the content of the cyclic siloxane compound in the carrier adjusted to 100 ppb or less makes change of the charge amount of an electrophotographic developer after aging less.

Cyclic siloxane content in the carrier is preferable to be 80 ppb or less, more preferable to be 60 ppb or less to further reduce the change of charge amount after aging. The methods of manufacturing the carrier in which cyclic siloxane content in the carrier is adjusted to 100 ppb or less include using of the non-magnetic component composition containing the siloxane compound having the average mass molecular weight of 150 to 10000, followed by appropriate curing in suitable conditions. It is preferable to select suitable curing conditions to the non-magnetic component composition to completely cure the non-magnetic component composition not to remain uncured products as described above. If the same curing conditions are employed, the larger mass average molecular weight of the siloxane compound in the range tends to make preparation of the carrier with the small cyclic siloxane content easy.

(2) Method of Determining the Cyclic Siloxane Content

To determine cyclic siloxane content in the carrier, the sample tube containing the sample is sealed by quartz wool at both ends, the sample tube is heated at 80° C. for 1 hour with the thermal desorber (such as TurboMatrix ATD, manufactured by PerkinElmer Inc.), and the gas component generated from the sample is quantitatively analyzed with the gas chromatograph/mass analyzer (such as Agilent 7890A manufactured by Agilent Technologies as a gas chromatography apparatus, 5975Cinert manufactured by Agilent Technologies as a mass spectrometer). In the quantitative analysis, the calibration curve is drawn using cyclic siloxane tetramer, and quantitation is carried out from the trimer to the 24-mer in terms of tetramer, and the sum is determined to be the cyclic siloxane content.

1-5. Volatile Organic Compound Content (1) Volatile Organic Compound Content in Carrier The volatile organic compound content in the carrier according to the present invention is preferable to be 1.5 ppm or less. If the volatile organic compound content in the carrier exceeds 1.5 ppm, the amount of volatile organic compounds discharged to the outside of the developing machine is large. So, it is not preferable for reducing the environmental load.

The volatile organic compounds contained in the carrier are roughly classified into aldehydes and non-aldehydes. The aldehydes include formaldehyde, and the non-aldehydes include toluene and methyl ethyl ketone.

The sum of the volatile organic compound content in the carrier is preferable that the sum of the aldehyde content is 0.1 ppm or less. If the sum of the aldehyde content exceeds 0.1 ppm in the sum of the volatile organic compounds in the carrier, the amount of the volatile organic compounds discharged to the outside of the developing machine is large.

(2) Volatile Organic Compound Content in Core Material

The sum of the volatile organic compound content in the core material for the carrier according to the present invention is preferable to be 0.5 ppm or less. If the sum of the volatile organic compound content in the core material exceeds 0.5 ppm, it influences on the sum amount in the carrier, and the amount of volatile organic compounds discharged to the outside of the developing machine is large.

The sum of the volatile organic compound content in the core material is preferable that the sum of the aldehyde content is 0.05 ppm or less. If the sum of the volatile organic compounds in the carrier exceeds 0.05 ppm, it influences on the sum amount in the carrier, and the amount of VOC discharged to the outside of the developing machine is large.

The content of volatile organic compounds and the sum of aldehydes in the carrier and the core material is preferable to be smaller to reduce the environmental load. So, there is no need to particularly define the lower limit.

(3) Method of Determining the Volatile Organic Compound Content

The volatile organic compound content in the carrier and the core material is determined in accordance with JIS A 1901:2003. Specifically, determination is conducted by the following method.

100 g of the sample is put into the SUS Petri dish with the bottom area of 80 $cm^2$ to prepare the test specimen. 10-L Tedlar bag (manufactured by GL Sciences Inc.) is filled with nitrogen gas, and the bag is washed by repeating heat treatment at 80° C. for 30 minutes and 3 times. The test specimen is put into the Tedlar bag. after washing and is sealed, and 5 L of high-purity nitrogen gass passed through activated carbon is introduced. Volatile organic compound components contained in the test specimen are evaporated by heating the Tedlar bag in the oven at 60° C. for 2 hours.

1 L of the nitrogen gas containing the evaporated organic compound component in the Tedlar bag is adsorbed by the TENAX-TA collecting tube manufactured by Supelco as the solid collector, and the non-aldehyde component is quantitatively analyzed using the gas chromatograph mass spectrometer. The examination conditions for the quantitative analysis is as follows.

Thermal desorber: PerkinElmer TurboMatrix ATD
Gas chromatograph: Agilent Technologies 7890A
Column: Agilent Technologies DB-5MS
Mass spectrometer: Agilent Technologies 5975C
Split ratio: 30:1

In the analysis, the time when the hexane peak is detected in the TIC chromatogram is referred to as T1, the time when the hexadecane peak is detected is referred to as T2, and the sum of all peaks detected in the time between T1 and T2 is determined to be in term of the toluene concentration as the sum amount of the non-aldehyde component evaporated.

3 L of the nitrogen gas containing the volatile organic compound components in the Tedlar bag is adsorbed by the InertSepmini AERO DNPH collecting tube manufactured by GL Sciences Inc. as a derivatization collector, and the aldehyde component is quantitatively analyzed by extraction with the solvent by high-performance liquid chromatography. The examination conditions for the quantitative analysis is as follows.

High performance liquid chromatograph: Waters ACQUITY UPLC H-Class system
Detector: Waters ACQUITY UPLC PDA eλ Detector (360 nm)
Column: Waters ACQUITY UPLC HSS C18
Mobile phase: Water/Acetonitrile/THF
Injection amount: 2 μL In the analysis, the aldehyde derivatives detected are quantitatively analyzed by using the calibration curve, and the sum is determined to be the sum amount of the aldehyde component evaporated.

The sum amount of the aldehyde component and the non-aldehyde component evaporated is determined to be the sum amount of the volatile organic compounds (T-VOC).

To make the aldehyde content in the volatile organic compounds and the volatile organic compounds in the core material or the carrier in the range, various methods are employed. Examples include selecting of the non-magnetic component and preparing the non-magnetic component composition used for preparing the non-magnetic component without using volatile organic solvents. The examples also include preparing of the resin compound used for coating the core material with the resin without using volatile organic solvents.

1-6. True Specific Gravity

The true specific gravity of the carrier according to the present invention is preferable to be 3.0 g/cm$^3$ to 4.5 g/cm$^3$. If the true specific gravity is less than 3.0 g/cm$^3$, a sufficient carrier strength cannot be ensured. If the true specific gravity exceeds 4.5 g/cm$^3$, it is difficult to reduce the weight of the carrier, reduction of the specific gravity of the carrier is insufficient.

The true specific gravity is examined with the picnometer in accordance with JIS R9301-2-1. The examination is carried out at the temperature of 25° C., using methanol as the medium. The true specific gravity of the core material is examined by the same method.

2. Method of Manufacturing Carrier

The method of manufacturing the carrier according to the present invention is the method of manufacturing the carrier in which the core material composed of the magnetic component and the non-magnetic component is coated with a resin, characterized in that the non-magnetic component is finished by curing the non-magnetic component composition containing the siloxane compound having the mass average molecular weight of 150 to 10000.

The siloxane compound is preferable to comprise one or more groups selected from methyl groups and phenyl groups, and a molar content ratio of the methyl groups and the phenyl groups in the non-magnetic component composition is 10:0 to 10:6.

The non-magnetic component composition is more preferable to contain the siloxane compound and the titanium alkoxide, and is prepared without using volatile organic solvents.

Regarding the items relating to the magnetic component and the non-magnetic component, the non-magnetic component composition should be the siloxane compound described above for the carrier according to the present invention. So, the descriptions thereof are omitted. The method of manufacturing the carrier will be described further in detail in Examples.

Conventionally known methods is appropriately employed for methods of manufacturing porous ferrite particles in the case where the magnetic component is porous ferrite particles. If the carrier according to the present invention is a so-called magnetic powder-dispersed resin carrier in which the magnetic component is dispersed in the non-magnetic component, conventionally known methods is appropriately employed as long as the method is employed for preparing the non-magnetic component.

The methods described above manufacture the carrier according to the present invention. However, the method of manufacturing the carrier according to the present invention is not limited to the methods described above. Any manufacturing method may be employed as long as water content and the cyclic siloxane compound content in the carrier are in the range defined in the present invention.

3. Electrophotographic Developer

The electrophotographic developer according to the present invention is characterized in using the carrier according to the present invention. It is preferable that the electrophotographic developer according to the present invention is a two-component electrophotographic developer containing the carrier and the toner.

In the electrophotographic developer according to the present invention, the toner used together with the carrier is not specifically limited. For example, various toners manufactured using known methods such as suspension polymerization, emulsion polymerization, and the pulverization is used. For example, the toner manufactured by sufficiently mixing the binder resin, a coloring agent, the charge control agent with the mixer such as Henschel mixer, and melt-kneading the mixture with the twin screw extruder to achieve uniform dispersion, followed by cooling, pulverization with the jet mill, and classification with the air classifier to the desired particle size is used. In the manufacturing of the toner, a wax, a magnetic powder, a viscosity modifier, and other additives may be contained according to needs. External additives may be further added after the classification.

Even though the binder resin used in manufacturing of the toner is not specifically limited, resins such as polystyrene, chloropolystyrene, a styrene-chlorostyrene copolymer, a styrene-acrylic acid ester copolymer, a styrene-methacrylic acid copolymer, further a rosin-modified maleic acid resin, an epoxy resin, polyester, polyethylene, polypropylene, polyurethane, and a silicone resin are used alone or in combination according to needs.

Examples of the charge control agent used in the manufacturing of the toner include a nigrosine dye, a quaternary ammonium salt, an organic metal complex, a chelate complex, and a metal-containing monoazo dye.

As the coloring agent used in the manufacturing of the toner, conventionally known dyes and/or pigments is used. For example, carbon black, phthalocyanine blue, permanent red, chromium yellow, and phthalocyanine green are used.

As the other external additives, silica, titanium oxide, barium titanate, fluororesin fine particles, acrylic resin fine particles are used alone or in combination. Further, a surfactant, a polymerization agent, may be added at discretion.

The electrophotographic developer according to the present invention is characterized in using the carrier according to the present invention, and other items are optional. That is, the electrophotographic developer is just one embodiment of the present invention, and the combination with the toner is appropriately arranged without departing from the intended scope of the present invention.

The present invention will be specifically described with referring to Examples and Comparative Examples. Note that, the present invention is not limited to the following examples.

EXAMPLE 1

Porous ferrite particles as the magnetic component were prepared as follows.

Raw materials were weighed to adjust MnO: 38 mol %, MgO: 11 mol %, $Fe_2O_3$: 50.3 mol %, and SrO: 0.7 mol %. Note that, trimanganese tetroxide was used as the raw material for MnO, magnesium hydroxide was used as the raw material for MgO, and strontium carbonate was used as the raw material for SrO.

Weighed raw materials were pulverized with the dry media mill (vibration mill, ⅛-inch diameter stainless steel particles) for 4.5 hours, and the pulverized material prepared was pelletized in about 1-mm square with the roller compactor. The pellets were classified with the vibration sieve having the mesh opening of 3 mm to remove coarse particles and the fine particles were removed with the vibration sieve having the mesh opening of 0.5 mm, followed by heating in the rotary electric furnace at 1050° C. for 3 hours for calcination.

Next, the slurry was prepared by pulverizing the pellets with the dry media mill (vibration mill, ⅛-inch diameter stainless steel particles) to adjust the average particle size about 4 μm, adding water, and pulverizing with the wet media mill (vertical particle mill, 1/16-inch diameter stainless steel particles) for 10 hours. The granules were prepared by adding an appropriate amount of the dispersant and adding PVA (20% solution) as the binder to the slurry prepared in the amount of 0.2 mass % against to the solid content, and granulating and drying with the spray dryer. Then, the granules were adjusted the particle size, heated in a rotary electric furnace at 700° C. for 2 hours for removing organic components such as the dispersant and the binder.

Then, the granules heat-treated were kept in the tunnel electric furnace for firing at the temperature of 1065° C. for 5 hours in the atmosphere with the oxygen gas concentration of 0.3 vol % to prepare the fired material. In the firing, the rate of temperature elevating was 150° C/hour, and the rate of temperature falling was 110° C/hour. Then, the magnetic component composed of porous ferrite particles were prepared by deagglomerating the fired material, adjusting the particle size by classification, and separating the low magnetic materials by magnetic separation.

Next, the pores of the porous ferrite particles were filled with the non-magnetic component as follows. The solution of the non-magnetic component composition was prepared as follows. Against to 100 parts by mass of the porous ferrite particles, 8 parts by mass of the siloxane compound-1 (component concentration of 100%, molar ratio of methyl groups/phenyl groups contained with NMR of 10:0, and mass average molecular weight Mw with GPC of 2100) and 7.1 mass % (1 mass % in terms of Ti atoms) of tetra-normal butyl titanate as the catalyst against to the siloxane compound were added, and 3 mass % of 3-aminopropyltriethoxysilane as the organic silane compound (aminosilane coupling agent) against to the siloxane compound was added to prepare the solution of the non-magnetic component composition.

100 parts by mass of the porous ferrite particles and the solution of the non-magnetic component composition prepared were put into the universal mixer, and the pores of the porous ferrite particles were filled with the solution of the non-magnetic component composition by immersion drying. The porous ferrite particles filled with the non-magnetic component composition were taken out from the universal mixer, and were heat-treated in the hot air heating oven at 265° C. for 2 hours to cure the non-magnetic component composition to finish the siloxane compound as the non-magnetic component according to the present invention.

After cooling to room temperature, the porous ferrite particles filled with their pores with the non-magnetic component were taken out from the oven, aggregates of the particles were disaggregated with the vibration sieve having the mesh opening of 200 M, and the non-magnetic material not filling the pores were removed with the magnetic separator. Then, the porous ferrite particles filled with the non-magnetic component, and the core material in Example 1 was prepared by further removing the coarse particles with the vibration sieve.

The surface of the core material prepared was coated with the resin by the following procedure. The resin solution was prepared by mixing 20 parts by mass of the solid acrylic resin (product name: BR-73, manufactured by Mitsubishi Rayon Co., Ltd.) and 80 parts by mass of toluene to dissolve in toluene. The resin solution was further added 1 mass % of carbon black (product name: Mogul L, manufactured by Cabot Corporation) as the conductive control agent against to the acrylic resin to prepare the coating resin solution.

The core material and the coating resin solution were put into the versatile mixer to carry out resin coating by immersion drying. Amount of the acrylic resin (solid resin content) in the coating resin solution was 1.2 parts by mass against to 100 parts by mass of the core material. After coating the surface of the core material with the coating resin, the coated core material was heated at 145° C. for 2 hours, aggregates of the coated core material were disaggregated with the vibration sieve having the mesh opening of 200 M, and the non-magnetic component was removed with the magnetic separator. Then, coarse particles were further removed with the vibration sieve. After finishing the steps, the non-magnetic component-filled ferrite carrier in which the surface of the core material composed of the magnetic component and the non-magnetic component was coated with the resin was prepared.

EXAMPLE 2

The carrier in Example 2 was prepared in the same manner as in Example 1 except that the siloxane compound-2 (component concentration of 100%, molar ratio of methyl groups/phenyl groups contained with NMR of 10:0, and mass average molecular weight Mw with GPC of 6200) was used instead of the siloxane compound-1.

EXAMPLE 3

The carrier in Example 3 was prepared in the same manner as in Example 1 except that the siloxane compound-3 (component concentration of 100%, molar ratio of methyl groups/phenyl groups contained with NMR of 10:2, and mass average molecular weight Mw with GPC of 4000) was used instead of the siloxane compound-1.

EXAMPLE 4

The carrier in Example 4 was prepared in the same manner as in Example 1 except that the siloxane compound-4 (component concentration of 100%, molar ratio of methyl groups/phenyl groups contained with NMR of 10:5, and mass average molecular weight Mw with GPC of 700) was used instead of the siloxane compound-1.

COMPARATIVE EXAMPLES

Comparative Example 1

The carrier in Comparative Example 1 was prepared in the same manner as in Example 1 except that tetra-normal butyl titanate as the catalyst and 3-aminopropyltriethoxysilane as the aminosilane coupling agent were not added, and the temperature of the heat treatment of the porous ferrite particles after filling the solution of the non-magnetic component composition was changed to 250° C.

Comparative Example 2

The carrier in Comparative Example 2 was prepared in the same manner as in Example 1 except that the amount of tetra-normal butyl titanate as the catalyst added was changed to 0.7 mass % (0.1 mass % in terms of Ti atoms) against to the siloxane compound, and the temperature of the heat treatment of the porous ferrite particles after filling the solution of the non-magnetic component composition was changed to 220° C.

Comparative Example 3

The carrier in Comparative Example 3 was prepared in the same manner as in Example 1 except that the siloxane compound-5 (component concentration of 100%, molar ratio of methyl groups/phenyl groups contained with NMR of 10:0, and mass average molecular weight Mw with GPC of 490) was used instead of the siloxane compound-1.

EVALUATION

1. Evaluation Items

Table 1 shows the firing conditions and the properties of the magnetic component constituting the carriers prepared in Examples 1 to 4 and Comparative Examples 1 to 3. Table 2 shows the filling conditions of the non-magnetic component for the magnetic component and the properties of the core material. Table 3 shows the characteristics and the properties of the carrier.

Tables will be explained in the order.

(1) Firing Conditions of Magnetic Component and Properties of Magnetic Component As shown in Table 1, the same porous ferrite particles were used as the magnetic component in Examples 1 to 4 and Comparative Examples 1 to 3. Table 1 shows the firing temperature and the oxygen concentration in the firing atmosphere as the firing conditions of the magnetic component. Further, Table 1 shows the pore volume, peak pore size, average particle size, saturation magnetization, and true specific gravity of the porous ferrite particles as the properties of the magnetic component. Note that, the pore volume, the peak pore size, and the true specific gravity were determined by the methods described above.

The average particle size and saturation magnetization were examined as follows.

Determination of Volume-Average Particle Size

The average particle size (volume-average particle size) of the porous ferrite particles was determined with Microtrac particle size analyzer (Model 9320-X100), manufactured by NIKKISO CO., LTD. The sample for examination was prepared as follows using water as the dispersion medium. 10 g of the sample and 80 ml of water were put into a 100-ml beaker, and 2 to 3 drops of the dispersant (sodium hexametaphosphate) were added. Then, dispersion was carried out for 20 seconds with the ultrasonic homogenizer (UH-150, manufactured by SMT Co., LTD.) with the output level 4. Next, bubbles formed on the surface of the liquid were removed. The sample prepared was examined using the Microtrac particle size analyzer.

Determination of Saturation Magnetization

The saturation magnetization of the porous ferrite particles was determined using the integral-type B-H TRACER BHU-60 (manufactured by Riken Denshi Co., Ltd.). The specific procedure was as follows. The H coil for magnetic field examination and the 4πI coil for magnetization examination were set between electromagnets. Note that, the sample was put into the 4πI coil. The output of the H coil and the output of the 4πI coil were each integrated while changing the magnetic field H by changing the current for the electromagnets, and the hysteresis curve was drawn on the recording paper with the X axis for the output of the H coil and the Y axis for the output of the 4πI coil. The examination conditions were: filling amount of sample is about 1 g, cells filled with sample have the inner diameter of 7 mmφ±0.02 mm and the height of 10 mm±0.1 mm, and the number of turns in 4πI coil is 30.

(2) Filling Conditions of Non-Magnetic Component and Properties of Core Material Table 2 shows the filling conditions of the non-magnetic component into the porous ferrite particles and the properties of the core material in which the pores of the porous ferrite particles are filled with the non-magnetic component. Table 2 shows the filling conditions of the non-magnetic component, the type of the siloxane compound used for preparation of the non-magnetic component composition, the molar ratio of methyl groups/phenyl groups contained with NMR, the mass average molecular weight with GPC (GPC average Mw), the mass molecular weight based on the first peak (GPC Mw-1) and the mass molecular weight based on the second peak (GPC Mw-2) which were used for determination of the mass average molecular weight, the filling amount of the siloxane compound in the porous ferrite particles, the amount of the catalyst against to the siloxane compound, the amount of aminosilane against to the siloxane compound (the amount of the aminosilane coupling agent added), and the curing temperature. Table 2 also shows the sum amount of the volatile organic compound content in the core material (T-VOC), Si/Fe ratio, and water content in the core material (the water amount), as the properties of the core material.

Note that, the molar ratio of methyl groups/phenyl groups contained with NMR and the mass average molecular weight with GPC is determined by the methods described above. The sum amount of the volatile organic compound content (T-VOC) and water content in the core material is determined by the methods described above also. Si/Fe ratio in the core material was determined as follows.

Method of Determining the Si/Fe Ratio

Si/Fe ratio in the core material represents the amount of Si against to the amount of Fe contained in the magnetic component. The amount of Si is the amount mainly in the non-magnetic component, and the amount of Fe is the amount in the magnetic component. The fluorescent X-ray elemental analysis is the method of determining the amount of the element present along several μm depth from the surface of the carrier particles, and determine the amount of the resin present in the vicinity of the surface of the carrier particles. As an examination device, ZSX100s manufactured by Rigaku Corporation was used. About 5 g of the sample put into the vacuum powder sample container (RS640: manufactured by Rigaku Corporation) was set into the sample holder, and Si and Fe were examined with the examination device. Note that, the examination conditions were: Si-Kα line was used as the examination line for Si, the tube voltage was 50 kV, the tube current was 50 mA, PET was used as the analyzing crystal, and PC (proportional counter) was used as the detector. Fe-Kα line was used as the examination line for Fe, the tube voltage was 50 kV, the tube current was 50 mA, LiF was used as the analyzing crystal, and SC (scintillation counter) was used as the detector. Based on the respective fluorescent X-ray intensities, the intensity ratio (Si intensity/Fe intensity) was calculated.

(3) Coating Conditions of Carrier and Properties of Carrier

Table 3 shows the coating conditions of the carrier, the resin content, the carbon content, and the curing temperature of the coating resin on the core material. Table 3 shows the properties of the carrier, sum amount of the volatile organic compound content (T-VOC), water content, cyclic siloxane content, the true specific gravity, and the charge amount of the carrier. Table 3 shows the charge amounts, the charge amount in the environment low-temperature and low-humidity (LL charge amount), the charge amount in the environment normal-temperature and normal-humidity (NN charge amount), the charge amount in the environment high-temperature and high-humidity (HH charge amount), the difference in charge amount between environments (the difference between the HH charge amount and the LL charge amount), and the change ratio in charge amount after aging (change ratio in NN charge amount after aging).

The amount of aldehyde component and the amount of non-aldehyde component were determined by the methods described above, and the sum amount of the volatile organic compound content (T-VOC) was determined. Water content, cyclic siloxane content, and the true specific gravity of the carrier were determined by the methods described above. The charge amount was determined by the following method.

Method of Determining the Charge Amount

The charge amount was determined on the mixture of the carrier and the toner with the suction-type charge amount examination device (Epping q/m-meter, manufactured by PES-Laboratoriumu).

The commercially available negative toner (cyan toner for DocuPrintC3530, manufactured by Fuji Xerox Co., Ltd., having the average particle size of about 5.8 μm) used for full color printers was used as the toner, and 10 g of the developer having the toner density of 10 mass % was prepared. The developer was put into a 50-cc glass bottle, and the glass bottle was housed and fixed in a circular cylindrical holder having a diameter of 130 mm and a height of 200 mm, followed by stirring for 30 minutes with the TURBULA mixer manufactured by SHINMARU ENTERPRISES CORPORATION, to determine charge amounts using the 635 mesh net in the following specific environmental conditions. To make the developers fit to each environment, the developers were exposed in the environments for 24 hours, and then the charge amount of developers were determined.

In the determination of the charge amount, the following conditions were employed as the specific environment conditions.

Environment low-temperature and low-humidity (LL environment): The temperature is 10 to 15° C., and the relative humidity is 10 to 15%.

Environment normal-temperature and normal-humidity (NN environment): The temperature is 20 to 25° C., and the relative humidity is 50 to 60%.

Environment high-temperature and high-humidity (HH environment): The temperature is 30 to 35° C., and the relative humidity is 80 to 85%.

Then, the charge amount determined in the environment low-temperature and low-humidity is referred to as LL charge amount, the charge amount examined in the environment normal-temperature and normal-humidity is referred to as NN charge amount, and the charge amount examined in the environment high-temperature and high-humidity is referred to as HH charge amount.

The difference between HH charge amount and LL charge amount was determined, and is referred to as the environmental difference in charge amount.

The change ratio of the charge amount after aging was determined as follows. The prepared developer was stirred by the same procedure as described above, and was housed in the glass bottle with the cover closed and kept for 100 days in the environment high-temperature and high-humidity. After keeping for 100 days, the environment was changed to the environment normal-temperature and normal-humidity, and then the charge amount was determined by the method described above. Then, the change ratio after aging was determined by the following formula.

Change ratio after aging=(NN charge amount after keeping for 100 days)/(NN charge amount before keeping)

2. Evaluation Results

As shown in Table 1, the same porous ferrite particles are used as the magnetic component in the carriers prepared in Examples 1 to 4 and Comparative Examples 1 to 3.

However, the filling conditions of the non-magnetic component composition are different in Examples 1 to 4 and Comparative Examples 1 to 3 as shown in Table 2. That is, the mass average molecular weight of the siloxane compound used in the preparation of the non-magnetic component composition and the molar ratio of methyl groups/phenyl groups contained in the siloxane compound with NMR are different. Further, the contents of the catalysts in the non-magnetic component compositions are different, and the curing temperature are also partially different in Examples and Comparative Examples. Water content in the core material can be adjusted by appropriately controlling the difference in the filling conditions of the non-magnetic component composition and the curing conditions. Note that, the filling conditions of the non-magnetic component include the number-average molecular weight of the siloxane compound, the molar ratio of methyl groups/phenyl groups contained, and the presence or absence of organic silane compounds.

As shown in Table 3, water content and cyclic siloxane content in the prepared carrier are different in Examples 1 to 4 and Comparative Examples 1 to 3 because the filling conditions of the non-magnetic component composition are different. The water content of the carriers in Examples 1 to 4 are 200 ppm or less, more specifically, 170 ppm or less. Further, cyclic siloxane content are 100 ppb or less, more specifically, less than 15 ppb. In contrast, water content of the carriers in Comparative Examples 1 and 2 exceeds 200 ppm, and is out of the range of the present invention. Further, cyclic siloxane content of the carriers in Comparative Examples 1 and 3 exceeds 100 ppb, and is out of the range of the present invention.

The environmental difference in charge amount in the carriers in Examples 1 to 4 is 10 or less and the change ratio in charge amount after aging is 0.9 or more. So, the matter is confirmed that, if water content and cyclic siloxane content in the carrier are in the range of the present invention, the carrier achieves less environmental fluctuation in charge amount and less change of the charge amount after aging. In contrast, in the carriers in Comparative Examples 1 and 2, water content is out of the range of the present invention, the environmental difference in charge amount exceeds 10, and the matter is confirmed that the charge amount tends to fluctuate due to changes in the environment (humidity and temperature) in comparison with the carriers according to the present invention. Further, the change ratio in charge amount after aging of the carriers in Comparative Examples 1 and 3 having cyclic siloxane content out of the range of the present invention is less than 0.9. So, the matter is confirmed that the carriers having cyclic siloxane content exceeding 100 ppb is large in change of the charge amount after aging in comparison with the carriers according to the present invention.

Note that, larger the mass average molecular weight of the siloxane compound used in the preparation of the non-magnetic component composition, easier the preparation of the carrier having small cyclic siloxane content. Further, larger the molar ratio of methyl groups/phenyl groups contained in the siloxane compound, easier the preparation of the carrier having small water content. However, cyclic siloxane content and water content fluctuate depending on the curing conditions. So, it is important to employ suitable curing conditions corresponding to the non-magnetic component composition at discretion, to prepare the carrier according to the present invention.

TABLE 1

| | Firing conditions of magnetic component | | Properties of magnetic component | | | | |
|---|---|---|---|---|---|---|---|
| | Firing temperature (° C.) | Oxygen concentration (vol %) | Pore volume ($mm^3/g$) | Peak pore size (μm) | Average particle size (μm) | Saturation magnetization (emu/g) | True specific gravity ($g/cm^3$) |
| Example 1 | 1065 | 0.3 | 68 | 0.52 | 39.7 | 70 | 4.83 |
| Example 2 | 1065 | 0.3 | 68 | 0.52 | 39.7 | 70 | 4.83 |
| Example 3 | 1065 | 0.3 | 68 | 0.52 | 39.7 | 70 | 4.83 |
| Example 4 | 1065 | 0.3 | 68 | 0.52 | 39.7 | 70 | 4.83 |
| Comparative Example 1 | 1065 | 0.3 | 68 | 0.52 | 39.7 | 70 | 4.83 |
| Comparative Example 2 | 1065 | 0.3 | 68 | 0.52 | 39.7 | 70 | 4.83 |
| Comparative Example 3 | 1065 | 0.3 | 68 | 0.52 | 39.7 | 70 | 4.83 |

TABLE 2

| | Filling conditions of non-magnetic component | | | | | | | | | Properties of core material | | |
|---|---|---|---|---|---|---|---|---|---|---|---|---|
| | Type of siloxane compound | NMR Me:Ph ratio | GPC Mw-1 | GPC Mw-2 | GPC average Mw | Siloxane compound content (mass %) | Catalyst content (mass %) | Aminosilane content (mass %) | Curing temperature (° C.) | T-VOC (ppm) | Si/Fe | Water content (ppm) |
| Example 1 | 1 | 10:0 | 530 | 3300 | 2100 | 8 | 1 | 3 | 265 | 0.31 | 0.0061 | 122 |
| Example 2 | 2 | 10:0 | 6200 | — | 6200 | 8 | 1 | 3 | 265 | 0.26 | 0.0060 | 121 |
| Example 3 | 3 | 10:2 | 830 | 4900 | 4000 | 8 | 1 | 3 | 265 | 0.34 | 0.0049 | 72 |
| Example 4 | 4 | 10:5 | 700 | — | 700 | 8 | 1 | 3 | 265 | 0.29 | 0.0046 | 67 |
| Comparative Example 1 | 1 | 10:0 | 530 | 3300 | 2100 | 8 | — | — | 250 | 0.11 | 0.0048 | 327 |

TABLE 2-continued

| | Filling conditions of non-magnetic component | | | | | | | | | Properties of core material | | |
|---|---|---|---|---|---|---|---|---|---|---|---|---|
| | Type of siloxane compound | NMR Me:Ph ratio | GPC Mw-1 | GPC Mw-2 | GPC average Mw | Siloxane compound content (mass %) | Catalyst content (mass %) | Aminosilane content (mass %) | Curing temperature (° C.) | T-VOC (ppm) | Si/Fe | Water content (ppm) |
| Comparative Example 2 | 1 | 10:0 | 530 | 3300 | 2100 | 8 | 0.1 | 3 | 220 | 0.18 | 0.0058 | 212 |
| Comparative Example 3 | 5 | 10:0 | 490 | — | 490 | 8 | 1 | 3 | 265 | 0.33 | 0.0056 | 135 |

TABLE 3

| | Coating conditions of carrier | | | Properties of carrier | | | | | | | | |
|---|---|---|---|---|---|---|---|---|---|---|---|---|
| | Resin content (mass %) | Carbon content (mass %) | Curing temperature (° C.) | T-VOC (ppm) | Water content (ppm) | Sum amount of cyclic siloxane (ppb) | True specific gravity | LL Charge amount (μC/g) | NN Charge amount (μC/g) | HH Charge amount (μC/g) | Environmental difference in charge amount (HH − LL) | Change ratio in charge amount after aging |
| Example 1 | 1.2 | 1.0 | 145 | 1.1 | 145 | 14 | 3.99 | −36.5 | −32.4 | −29.1 | 7.4 | 0.96 |
| Example 2 | 1.2 | 1.0 | 145 | 1.0 | 169 | <10 | 4.00 | −36.9 | −31.7 | −27.8 | 9.1 | 0.97 |
| Example 3 | 1.2 | 1.0 | 145 | 1.2 | 117 | <10 | 4.00 | −35.1 | −31.7 | −28.3 | 6.8 | 0.98 |
| Example 4 | 1.2 | 1.0 | 145 | 1.0 | 109 | <10 | 4.02 | −35.8 | −32.5 | −29.6 | 6.2 | 0.96 |
| Comparative Example 1 | 1.2 | 1.0 | 145 | 0.9 | 351 | 108 | 4.01 | −37.6 | −32.9 | −25.3 | 12.3 | 0.88 |
| Comparative Example 2 | 1.2 | 1.0 | 145 | 0.9 | 234 | 67 | 3.99 | −38.7 | −33.2 | −27.2 | 11.5 | 0.91 |
| Comparative Example 3 | 1.2 | 1.0 | 145 | 1.0 | 155 | 129 | 4.04 | −35.3 | −30.8 | −27.0 | 8.3 | 0.84 |

INDUSTRIAL APPLICABILITY

The present invention provides the carrier low in specific gravity and less in environmental fluctuation in charge amount and less in change of the charge amount after aging.

So, if the electrophotographic developer is composed of the carrier and a toner, the fluctuation in charge amount is reduced, even if the temperature and the humidity in the environment (atmosphere) of the electrophotographic developer fluctuate. Further, the reduction in charge amount after aging the electrophotographic developer is reduced.

What is claimed is:

1. A carrier which is a core material composed of a magnetic component and a non-magnetic component coated with a resin, characterized in that the carrier has water content of 200 ppm or less and cyclic siloxane content of 100 ppb or less.

2. The carrier according to claim 1, wherein the carrier has a volatile organic compound content of 1.5 ppm or less.

3. The carrier according to claim 1, wherein the carrier has a true specific gravity of 3.5 g/cm$^3$ or more and 4.5 g/cm$^3$ or less.

4. The carrier according to claim 1, wherein the magnetic component is a ferrite.

5. The carrier according to claim 1, wherein the non-magnetic component is a siloxane compound comprising one or more groups selected from methyl groups and phenyl groups.

6. The carrier according to claim 5, wherein the non-magnetic component is finished by curing a non-magnetic component composition without volatile organic solvents containing the siloxane compound having a mass average molecular weight of 150 to 10000.

7. The carrier according to claim 1, wherein the core material is composed of porous ferrite particles and the non-magnetic component filling the pores in the porous ferrite particles.

8. An electrophotographic developer containing the carrier according to claim 1.

* * * * *